US006855007B2

(12) United States Patent
Irish et al.

(10) Patent No.: US 6,855,007 B2
(45) Date of Patent: Feb. 15, 2005

(54) SWITCH CONNECTOR AND METHOD

(75) Inventors: Kenneth G. Irish, Chicago, IL (US); James A. Turek, Lagrange, IL (US)

(73) Assignee: Illinois Tool Works Inc., Glenview, IL (US)

( * ) Notice: Subject to any disclaimer, the term of this patent is extended or adjusted under 35 U.S.C. 154(b) by 53 days.

(21) Appl. No.: 10/424,861

(22) Filed: Apr. 28, 2003

(65) Prior Publication Data

US 2004/0214472 A1 Oct. 28, 2004

(51) Int. Cl.[7] ..... H01J 1/00; H01K 1/00
(52) U.S. Cl. ..... 439/614; 439/106; 439/954
(58) Field of Search ..... 439/614, 106, 439/172–175, 222–224, 217, 954, 617

(56) References Cited

U.S. PATENT DOCUMENTS 4,934,962 A * 6/1990 Luu et al. ..... 439/651
5,211,584 A * 5/1993 Lee ..... 439/652
6,024,588 A * 2/2000 Hsu et al. ..... 439/173
6,200,159 B1 * 3/2001 Chou ..... 439/535
6,302,717 B1 * 10/2001 Cheung ..... 439/172

FOREIGN PATENT DOCUMENTS

GB 2139017 A * 10/1984 ..... H01R/11/01
WO WO 88/04875 6/1988

OTHER PUBLICATIONS

Ford, "Changing Fascia (Dashboard) & Instrument Bulbs" [On Line] 2001 [Retreived Jul. 26, 2004] Retrieved From Internet: <URL:http://www.fordscorpio.co.uk/fasciabulb-s.htm>.

* cited by examiner

*Primary Examiner*—Hae Moon Hyeon
(74) *Attorney, Agent, or Firm*—Mark W. Croll; Paul F. Donovan

(57) ABSTRACT

A connector for connecting a plurality of wires to a sub-miniature switch and lamp socket assembly having tabs and a ground pin includes a molded, one-piece housing and a plurality of terminals for joining the plurality of wires to the tabs and ground pin. A plurality of openings are formed within the housing, accepting both the plurality of terminals and the tabs and ground pin of the assembly, and allowing the terminals to connect with the tabs and ground pin. The plurality of openings are formed within the bottom, front, and back faces of the housing. A method of connecting a sub-miniature switch and lamp socket assembly having tabs and a ground pin to a plurality of wires is also disclosed.

19 Claims, 5 Drawing Sheets

SWITCH CONNECTOR AND METHOD

BACKGROUND OF THE INVENTION

The present invention is directed to a device for connecting wires to a sub-miniature switch and lamp socket assembly. More particularly, the present invention pertains to a connector device having a molded, one-piece housing, terminals for joining the wires to the assembly, and openings formed within the housing to accept both the terminals and the assembly and facilitate their connection. A method of connection also is disclosed.

Sub-miniature switch/lamp socket assemblies with ground pins are commonly used in the electronic gaming industry to attach to push button assemblies (see FIG. 1 for a diagram of a typical subminiature switch/lamp socket assembly with ground pin). Tabs protrude from the sub-miniature switch and the lamp socket portions of the assemblies to facilitate connection with the wiring of other electronic components.

Presently, manufacturers connect wiring to the tabs and ground pin with commonly available single "fast-on" crimped terminals, or by soldering wires directly to the tabs and ground pin. The process of joining the correct wire to its tab or ground pin is left entirely to the assembler. As a result, mismatch of the wires and tabs/pins can occur. In addition, these types of connections can require significant labor and consequent cost to perform.

Accordingly, there exists a need for a connector for connecting wiring to sub-miniature switch and lamp socket assemblies. The housing and openings provided by such a device not only improve connection accuracy and speed, but render incorrect wire attachment a virtual impossibility.

BRIEF SUMMARY OF THE INVENTION

A device for use in connecting wires to a subminiature switch and lamp socket assembly having tabs and a ground pin includes a molded, one-piece housing and terminals for joining the wires to the tabs and ground pin. Openings are provided in the bottom, front, and back faces of the housing to accept the wire terminals and the tabs and ground pin of the assembly, and to allow the terminals to connected with the tabs and ground pin.

The housing and openings provided by the connector not only improve connection accuracy and speed, but render incorrect wire attachment a virtual impossibility.

A preferred housing is formed in three distinct steps, each one above and parallel to its prior step. Each step has openings formed within its bottom, front, and back faces. The bottom face of the first, lowest step has one opening shaped to accept the ground pin of the assembly.

A method of connecting wires to a sub-miniature switch and lamp socket assembly having tabs and a ground pin includes the steps of inserting the tabs and ground pin of the assembly into openings formed in a molded housing, attaching terminals to the wires, and inserting the terminals into openings formed in another, perpendicular face of the housing, allowing the terminals to connect with the tabs and ground pin of the assembly.

These and other features and advantages of the present invention will be apparent from the following detailed description, in conjunction with the appended claims

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
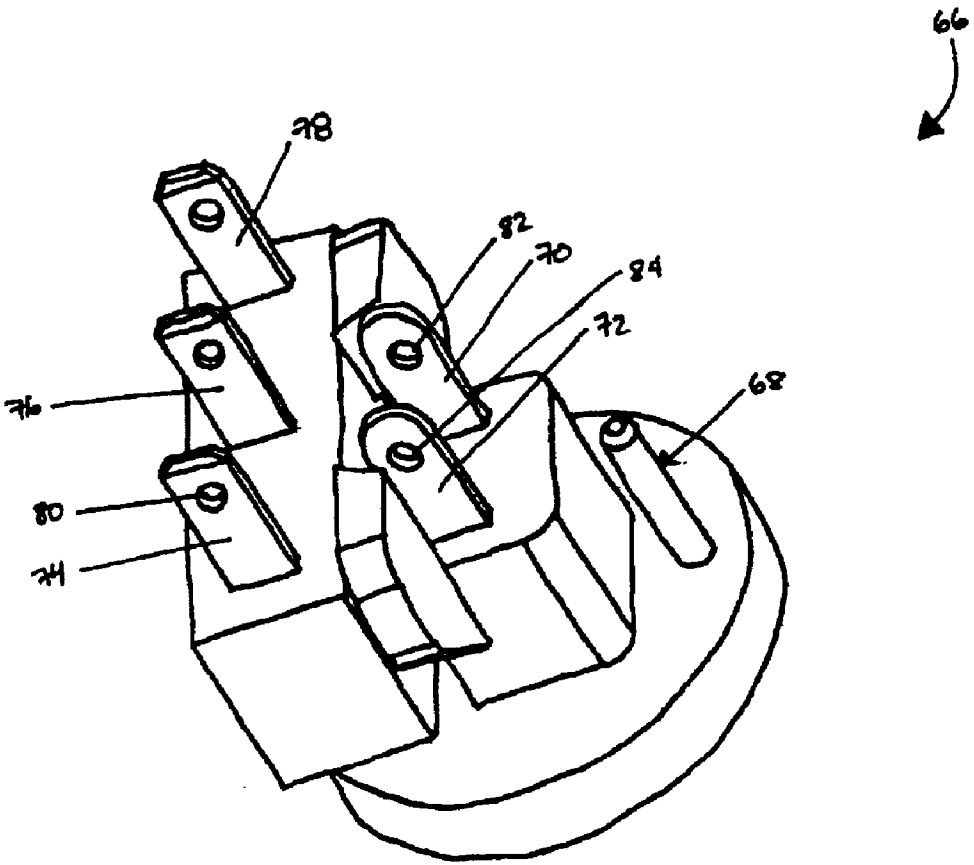
FIG. 1 is a perspective view illustrating a typical sub-miniature switch/lamp socket assembly with ground pin.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 2:
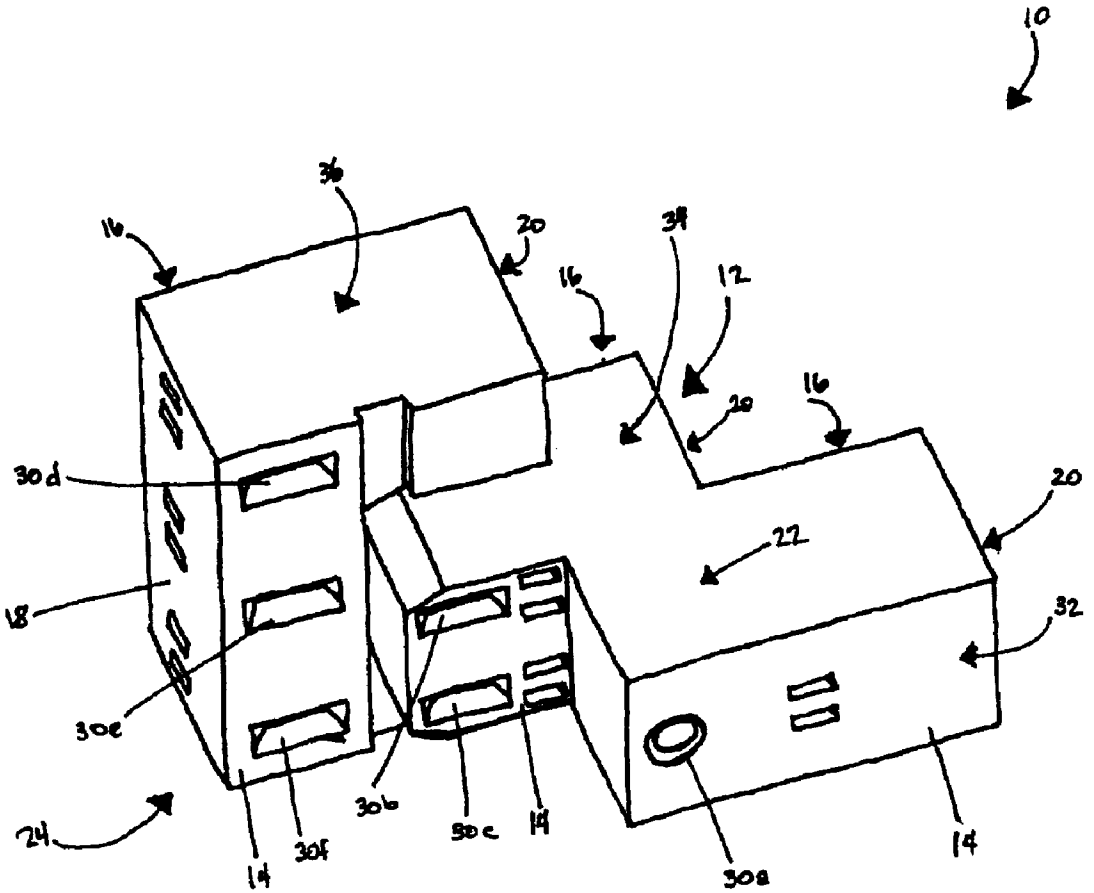
FIG. 2 is a bottom perspective view of the housing portion of a device for connecting wires to a sub-miniature switch and lamp socket assembly embodying the principles of the present invention.
Figure 3:
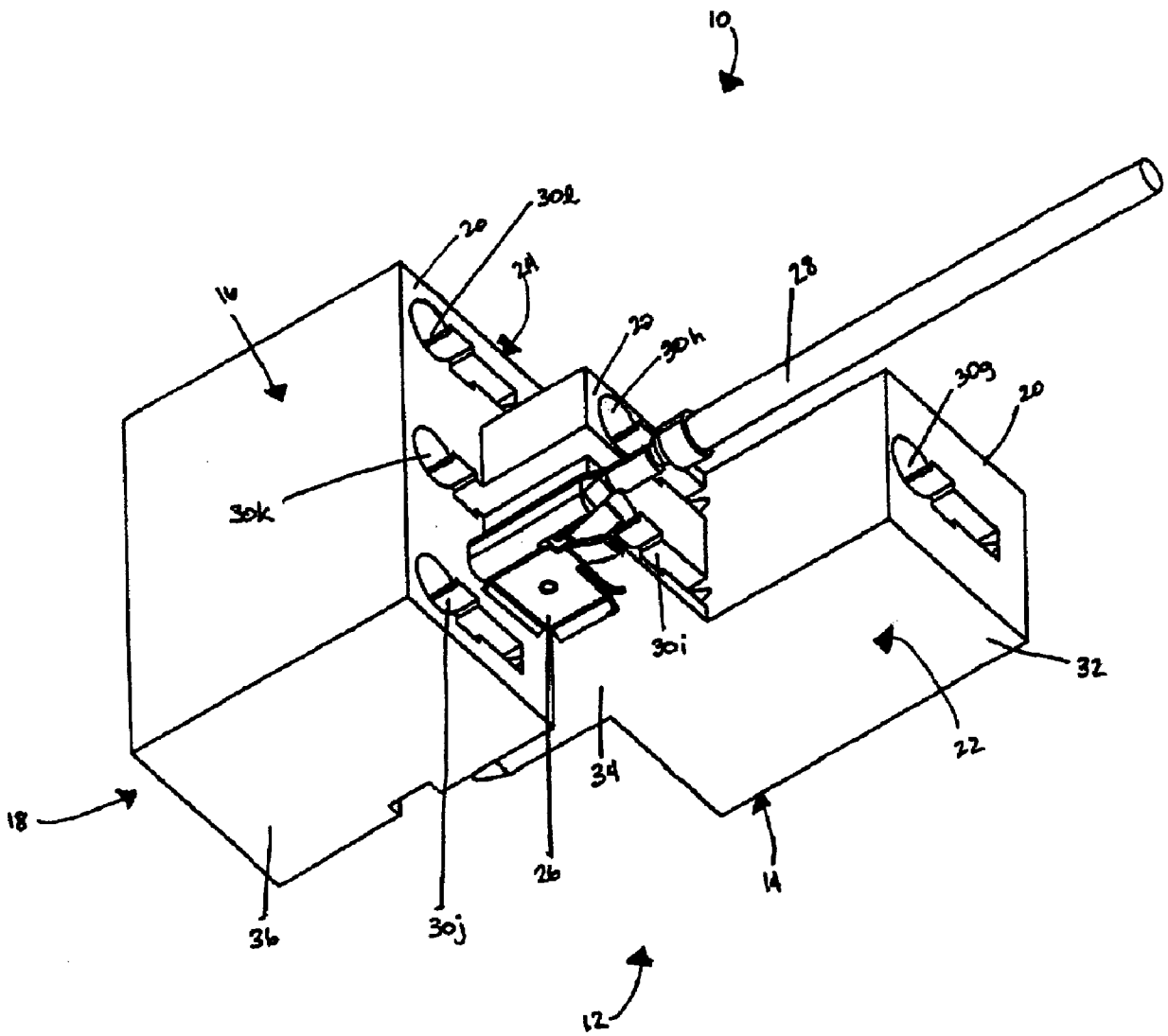
FIG. 3 is atop perspective view of the device of FIG. 2; demonstrating the insertion of a terminal connected to a wire into the housing portion.

Referring to the figures and in particular to FIGS. 2 and 3, there is shown a connector device 10 in accordance with the principles of the present invention. The device includes a molded, one-piece housing 12, having bottom 14, top 16, front 18, back 20, and side 22, 24 faces, a plurality of terminals 26 for attaching to a plurality of wires 28, and a plurality of openings 30 spaced from one another and formed within the housing 12.

In a preferred embodiment, the housing 12 is formed in three distinct steps 32, 34, and 36. Each step 34, and 36 defines a plane above and parallel to each prior step (32 and 34, respectively). Each step 32, 34, and 36 has openings 30 formed within its bottom 14, front 18, and back 20 faces.

In a current embodiment, one opening 30*a* is formed within the bottom face 14 of the first, lowest step 32. Two openings 30*b* and 30*c* are formed within the bottom face 14 of the second, middle step 34. Three openings 30*d*, 30*e*, and 30*f* are formed within the bottom face 14 of the third, highest step 36.

In a preferred embodiment, one additional opening 30*g* is formed within the back face 20 of the first, lowest step 32. Two additional openings 30*h* and 30*i* are formed within the back face 20 of the second, middle step 34. Three additional openings, 30*j*, 30*k*, and 30*l* are formed within the back face 20 of the third, highest step 36.

Figure 4:
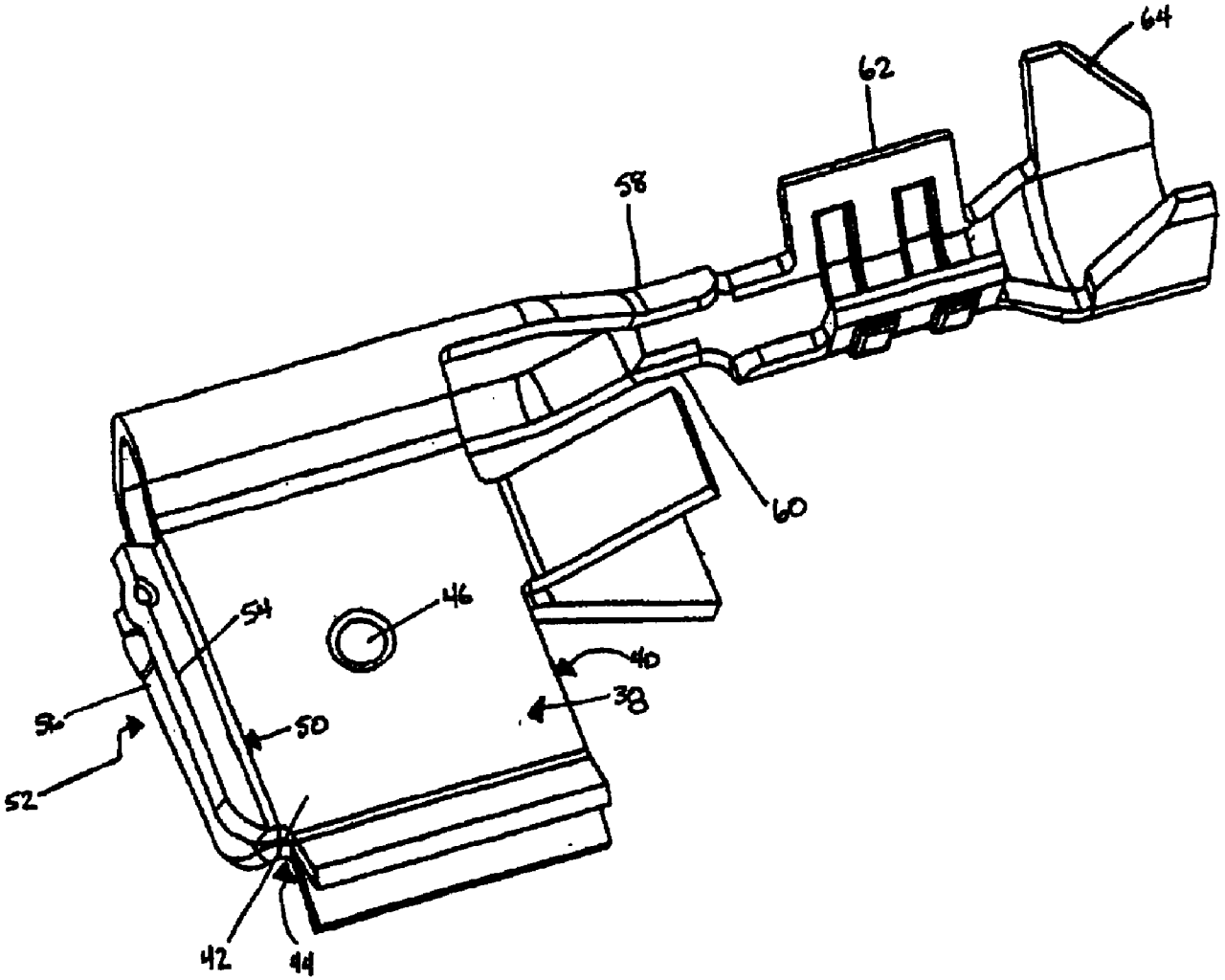
FIG. 4 is an enlarged view of the terminal of FIG. 3.

In a current embodiment, the terminals 26 are crimp-style terminals. As can be seen in FIG. 4, each terminal 26 includes a pair of flexible flaps 38, 40, both having outer faces 42, 44 with dimples 46, 48 formed therein; front edges 50, 52, with chamfered edges 54, 56; and back edges 58, 60. The back edges 58, 60 are attached to a wire crimp barrel 62. The wire crimp barrel 62 is in turn joined to an insulation crimp barrel 64.

Referring now to FIG. 1, there is shown a typical sub-miniature switch/lamp socket assembly with ground pin 66, such as may be used with the present invention. The assembly 66 includes a ground pin 68, lamp socket tabs 70, 72, and sub-miniature switch tabs 74, 76, and 78. The housing 12 is joined to the assembly 66 by inserting the ground pin 68 into the first step 32 bottom face 14 opening 30*a*, inserting the lamp socket tabs 70, 72 into the second step 34 bottom face 14 openings 30*b* and 30*c*, and inserting the miniature switch tabs 74, 76, and 78 into the third step 36 bottom face 14 openings 30*d*, 30*e*, and 30*f* (see FIG. 5).

Turning to FIG. 3, the terminal 26 is attached to the associated wire 28 and is inserted into the appropriate back face 20 and step 32, 34, 36 opening 30*g*–30*l*. Here, the terminal 26 is shown being inserted into opening 30*j* on the back face 20 of the third step 36. As the terminal 26 enters the opening 30*j*, it proceeds until the dimples 46, 48 located on the outer faces 42, 44 of the terminal 26 engage a hole or opening 80 located in the sub-miniature switch tab 74 (see FIG. 1). The terminal 26 operates similarly with the lamp socket tabs 70, 72, using its dimples 46, 38 to engage holes 82, 84 located in the lamp socket tabs 70, 72.

Figure 5:
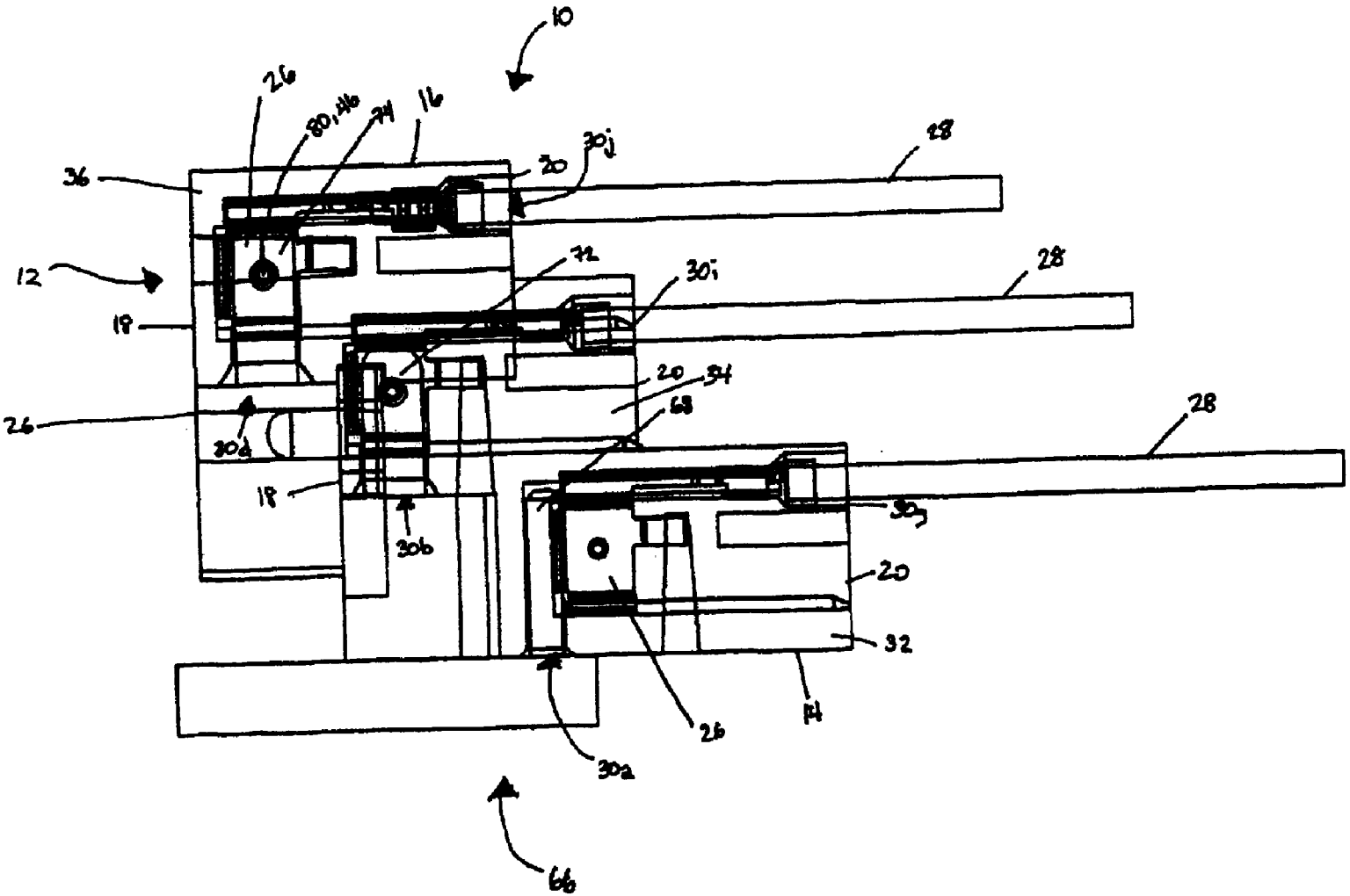
FIG. 5 is a sectional view of the connector device showing the terminals mated to the sub-miniature switch/lamp socket assembly with ground pin.

The terminal 26 joins with the ground pin 68 in a different manner. The chamfered edges 54, 56 of the terminal 26 engage with the ground pin 68 along the length of the ground pin 68. FIG. 5 illustrates the assembly 66 connected to the housing 12, with the terminals 26 mated to the ground pin 68, lamp socket tabs 70, 72, and subminiature switch tabs 74, 76, 78.

A method of connecting an assembly 66 to a plurality of wires 28 includes inserting the ground pin 68, lamp socket tabs 70, 72, and sub-miniature switch tabs 74, 76, and 78 of the assembly 66 into a plurality of openings 30*a*–*f* in a bottom face 14 of a molded, one-piece housing 12; attaching a plurality of terminals 26 to the wires 28; and then inserting the plurality of terminals 26 into a plurality of openings 30*g*–*l* in a back face 20 of the housing 12, allowing the plurality of terminals 26 to connect with the tabs 70–78 and ground pin 68 of the assembly 66.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modification as fall within the scope of the claims.

What is claimed is:

1. A connector device for use with a plurality of wires and a sub-miniature switch and lamp socket assembly having tabs and a ground pin, comprising:

a molded, one-piece housing having bottom, top, front, back, and side faces, wherein the bottom and top faces are positioned perpendicular to the front and back faces;

a plurality of terminals attached to the plurality of wires, for joining the plurality of wires to the tabs and ground pin; and a plurality of openings spaced from one another and formed within the housing, accepting both the plurality of terminals and the tabs and ground pin of the assembly, and allowing the plurality of terminals to connect with the tabs and ground pin of the assembly, wherein the plurality of openings are formed within the bottom, front, and back faces of the housing, and wherein the housing is formed in three distinct steps, each step defining a plane above and parallel to each prior step and each step having bottom, top, front, back, and side faces.

2. The connector in accordance with claim 1 wherein the plurality of openings formed within the bottom face of the housing are shaped to accept the tabs and ground pin of the assembly.

3. The connector in accordance with claim 2 wherein there are six openings formed within the bottom face of the housing.

4. The connector in accordance with claim 3 wherein the openings include three openings for switch tabs, two openings for lamp tabs and one opening for the ground pin.

5. The connector in accordance with claim 1 wherein the plurality of openings formed within the back face of the housing are shaped to accept the plurality of terminals.

6. The connector in accordance with claim 5 wherein there are six openings formed within the back face of the housing.

7. The connector in accordance with claim 1 wherein the plurality of openings are formed within the bottom, front, and back faces of each step of the housing.

8. The connector in accordance with claim 7 wherein there is one opening formed within the bottom face of the first, lowest step, shaped to accept the ground pin of the assembly.

9. The connector in accordance with claim 7 wherein the plurality of openings formed within the bottom face of the second, middle step are shaped to accept the lamp tabs of the assembly.

10. The connector in accordance with claim 9 wherein there are two openings formed within the bottom face of the second, middle step.

11. The connector in accordance with claim 7 wherein the plurality of openings formed within the bottom face of the third, highest step are shaped to accept the switch tabs of the assembly.

12. The connector in accordance with claim 11 wherein there are three openings formed within the bottom face of the third, highest step.

13. The connector in accordance with claim 7 wherein the plurality of openings formed within the back faces of each step are shaped to accept the plurality of terminals.

14. The connector in accordance with claim 13 wherein there is one opening formed within the back face of the first, lowest step.

15. The connector in accordance with claim 13 wherein there are two openings formed within the back of the second, middle step.

16. The connector in accordance with claim 13 wherein there are three openings formed within the back of the third, highest step.

17. The connector in accordance with claim 1 wherein the plurality of terminals are crimp style terminals.

18. A connector device for use with a plurality of wires and a sub-miniature switch and lamp socket assembly having tabs and a ground pin, comprising:

a molded, one-piece housing having bottom, top, front, back, and side faces, wherein the bottom and top faces are positioned perpendicular to the front and back faces;

a plurality of terminals attached to the plurality of wires, for joining the plurality of wires to the tabs and ground pin; and a plurality of openings spaced from one another and formed within the housing, accepting both the plurality of terminals and the tabs and ground pin of the assembly, and allowing the plurality of terminals to connect with the tabs and ground pin of the assembly, wherein the plurality of openings are formed within the bottom, front, and back faces of the housing, and wherein each of the plurality of terminals includes a pair of flexible flaps, having outer and inner faces, and front and back edges, a dimple formed on the outer face of each flap, a chamfered edge formed at the front edge of each flap, a wire crimp barrel at the back edge of each flap and an insulation crimp barrel joined to the wire crimp barrel.

19. A method of connecting a sub-miniature switch and lamp socket assembly having tabs and a ground pin to a plurality of wires, comprising the steps of:

providing a connector device having a molded, one-piece housing having bottom top, front, back, and side faces, in which the bottom and top faces are positioned perpendicular to the front and back faces, the housing having a plurality of openings formed therein spaced from one another, the housing being formed in three distinct steps, each step defining a plane above and parallel to each prior step and each step having bottom top, front, back, and side faces;

inserting the tabs and ground pin of the assembly into a plurality of openings in a first face of the molded, one-piece housing;

attaching a plurality of terminals to the plurality of wires; and inserting the plurality of terminals into a plurality of openings located within a second, perpendicular face of the housing, so that the plurality of terminals connect with the tabs and ground pin of the assembly.

* * * * *